US005566949A

United States Patent [19]

Gorden

[11] Patent Number: 5,566,949

[45] Date of Patent: Oct. 22, 1996

[54] TETHERED BALL GAME DEVICE

[76] Inventor: Don Gorden, 994 E. New Hope Dr., Draper, Utah 84020

[21] Appl. No.: 422,863

[22] Filed: Apr. 17, 1995

[51] Int. Cl.[6] ..... A63B 67/10

[52] U.S. Cl. ..... 273/345; 273/58 C; 273/346; 273/447; 273/448; 273/DIG. 30

[58] Field of Search ..... 273/330, 331, 273/334, 335, 342, 344, 345, 346, 347, 58 C, 140, 456, 447, 448, DIG. 30

[56] References Cited

U.S. PATENT DOCUMENTS

| | | | |
|---|---|---|---|
| 2,187,524 | 1/1940 | Price | 273/344 |
| 3,118,669 | 1/1964 | Merrill | 273/345 |
| 3,627,316 | 12/1971 | Machinski | 273/140 X |
| 3,830,498 | 8/1974 | Lauzon | 273/345 |
| 4,272,075 | 6/1981 | Rogers, Jr. | 273/1 E |
| 4,848,748 | 7/1989 | Krutsch | 273/121 |
| 5,110,136 | 5/1992 | Land | 273/346 |
| 5,181,726 | 1/1993 | Piaget | 273/330 X |
| 5,199,715 | 4/1993 | May | 273/331 |
| 5,288,083 | 2/1994 | Palmeri | 273/329 |
| 5,340,113 | 8/1994 | Respicio | 273/249 |
| 5,348,307 | 9/1994 | Duggan | 273/320 |
| 5,452,902 | 9/1995 | Foster et al. | 273/346 |

*Primary Examiner*—William H. Grieb
*Attorney, Agent, or Firm*—Mallinckrodt & Mallinckrodt

[57] ABSTRACT

A tethered ball game device is disclosed utilizing flat disk devices that are retrieved by the tethered ball or "snagger". The ball includes a magnet or hook and loop type fastener means and is therefore capable of attracting or attaching the flat disks or "caps". The tether is elastic in nature, thus allowing the snagger to be projected toward a group of caps, lying on the ground, attracting to one or more caps and then retrieving the caps, by virtue of the tether, in one continuous movement. A variety of games can be played utilizing the disclosed device in a manner that is far more challenging and creatively motivating than existing POG games or tethered ball games. The concept is simple enough that a child can master the level of coordination necessary to perform the tasks necessary to play the game yet the variations can be made complex enough that adults can find the games physically challenging. This stimulates hand to eye coordination in the users of all ages and skill levels and keeps the game interesting to players as they progress to more advanced levels of play.

22 Claims, 2 Drawing Sheets

TETHERED BALL GAME DEVICE

BACKGROUND OF THE INVENTION

1. Field of the Invention

The invention disclosed herein relates to a game device and more specifically to a game device comprising a tethered object and a target.

2. Overview of Prior Art

It has been long accepted that hand to eye coordination is developed by the process of taxing the muscular and nervous systems directly involved by performing relatively challenging physical acts. Games involving throwing or casting an object at a target is a prime example of such a task. The process of using a ball on a tether has been done on numerous occasions the primary variation being the reward process of hitting the target.

Duggan disclosed a hand held paddle device with a tethered ball and a target comprising a netted hole in the center of the paddle, in U.S. Pat. No. 5,348,307. The device utilizes a pair of such devices, one player casting the tethered ball into the others hand held target. The difficulty level is somewhat high due to the high coordination skill level of the players that would be necessary in order to score points. Playing any game without successful results by the players is of little value because the players soon tire of the activity.

This issue was addressed by Palmieri in U.S. Pat. No. 5,288,083 with marginal success. This disclosure shows a tethered ball attached to a handle with a circular section removed therefrom and providing an accessible path of travel for the ball to traverse there through upon swinging the ball from its suspended tether. The ease of performing the task with a simple movement of very little muscular stimulation also makes the device of marginal stimulation at best. In this case the device is to easy and therefore the rewards of successfully performing the task are minimal.

May, in U.S. Pat. No. 5,199,715 came up with a novel game in that two players support and manipulate a suspended, tethered ball via waist belts. For this hip action is used to manipulate the ball instead of upper limb movement. The inability of a single player to play or even practice the game, the limited dexterity of the human midsection and the relative lack of productive use in developing such dexterity., as compared to that of the upper limbs, make this a less than desirable game.

Board games have a long standing reputation of popularity with people of various backgrounds. "POG's" have of late become popular with the younger generation. Respicio, in U.S. Pat. No. 5,340,113 reveals a POG board game utilizing flat, cylindrical shaped disks (POG's) that are hit with a heavier disk, the object being to flip over some or all of the stack of POG's. This also becomes less than challenging as a physical activity, at least partially because the skill level is minimal in that only a few muscle groups are used to physically perform the task. The desire of the game has turned toward collecting POG's with a variety of designs on them, instead of the playing of the game.

In U.S. Pat. No. 4,848,748 Krutsch disclosed a device that utilizes an electromagnet to lift a metal ball. This device is used in relation to a game such as a pinball machine. The device rides on a track and does not lend itself to be used independently away from the machine.

A magnet on a tether device that picks up objects capable of being attracted to the magnet is disclosed by Rogers, Jr. in U.S. Pat. No. 4,272,075. This is a fishing game which utilizes a crane-like device to suspend the magnet and lower it into a section of the game frame where the "fish" are concealed. This device adds the reward of retrieving objects by operating a tethered object, thus creating a challenge, but minimal skill and physical stimulation is necessary since the operation of the device is limited to the placement of the "crane" and rotating the spool on which the crane's tether is attached.

SUMMARY OF THE INVENTION

The object of the disclosed invention is to provide a physically stimulating game that also provides a reward system that the player(s) do not easily tire from doing. To enable adequate physical stimulation, the players must involve many muscular systems, such as complex throwing movements and the like. The invention demands the hand to eye coordination of throwing an object into a target area and a reward of the object attracting or attaching to one or more target objects thereto and being retrieved by a tether attached to the thrown object. Such a device creates skill and coordination in the players by using complex, yet natural physical movements and a reward system that is conducive to further enjoyment of playing the game. Therefore the game can be played by children and adults, each skill level created by only minimal variations in complexity and restrictions to the game.

The preferred embodiment of the invention consists of a padded object with a magnet enclosed therein and an elastic tether attached to the object. The object is thrown at a target area where a series of metal disks are placed. The magnet attracts the disks and is retrieved by the user by use of the elastic tether. A variety of games and variations in those games can be played, each comprising a varied level of skill and complexity.

DETAILED DESCRIPTION OF THE PREFERRED EMBODIMENT

Figure 1:
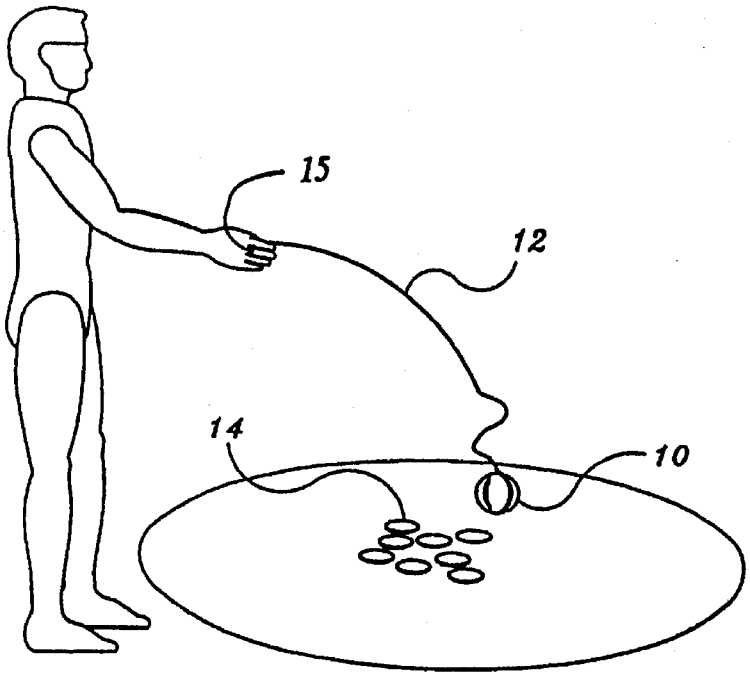
FIG. 1 is an isometric view of an example of a game device as it would be used in accordance with the preferred embodiment of the present invention.

Referring to the drawings, the general use of a device as constructed in accordance with the present invention is shown in FIG. 1, and comprises a snagger 10 which includes an elastic cord 12 and a plurality of caps 14. The cord 12 is secured to the user's hand or finger, such as by a loop 15 in the end of the elastic cord 12 which fits around a user's finger and the snagger 10 is thrown or cast into the area of the caps 14. The snagger has the ability to fasten or attract the caps 14 and upon contact, one with the other, the cap(s) can be retrieved by the user via the elastic cord 12, thus scoring one or more points for each cap obtained in this manner.

Figure 2:
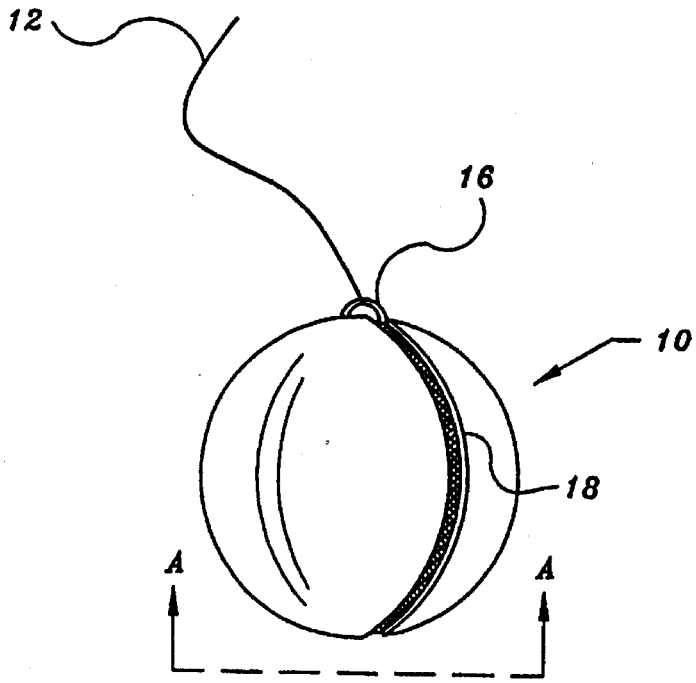
FIG. 2 is an isometric view of the snagger portion of the invention showing the attachment means of the cord and the groove located therein produced in accordance with the preferred embodiment of the present invention.

The snagger 10 is shown in more detail in FIG. 2. The snagger 10 includes a fastening means 16 for fastening the cord 12 to the snagger 10. A groove 18 of material is removed from the snagger 10 so as to allow the cord 12 to be wrapped up around the circumference of the snagger 10 for storage or as an alternative skill in playing the game. In this case the cord 12 is wound onto the snagger 10 as a yo-yo before casting the snagger 10. This makes the game more challenging due to the fact that only one side of the snagger 10 is capable of attracting or fastening to the cap. Thus, orientation of the snagger 10 at the point of contact is critical. It should be noted that the groove 18 is an added convenience but not a necessity in playing the game.

Figure 3:
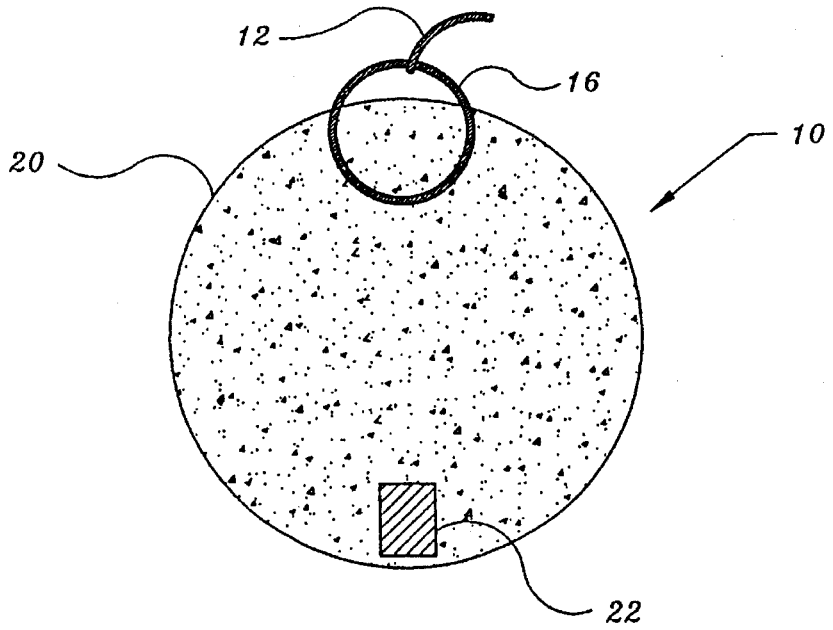
FIG. 3 is a sectioned view of the snagger sectioned along line A—A as shown in FIG. 2, showing the detail of the device produced in accordance with the preferred embodiment of the present invention.

To further show the detail of the snagger 10 a sectioned view of the device, cut along line A—A as depicted in FIG. 2, is shown in FIG. 3. The body 20 is comprised of an energy absorbing material such as a foam rubber product. This lends itself to be molded with other critical components of the snagger encapsulated therein. The purpose of the body is to hold the other components together and at the same time cushion the mass of the components from the user or other players if inadvertently struck by the device, thereby preventing injury to the players. The fastening means 16 here is shown as a wire or similar material and captured within the body 20. The cord 12 is attached thereto, supplying a secured means of attachment of the cord 12 to the body 20 opposite to a magnet 22, also enclosed therein. The magnet is the attractive means which attracts the metal caps, enabling them to be retrieved by the user. The magnet 22 can be any of a variety of permanent magnets, with a neodymium magnet, such as a neodymium grade 27 permanent magnet, presently preferred. It has been determined that a cylindrical shaped magnet is preferable. As shown in FIG. 3, magnet 22 is positioned in body 20 near the side of the body opposite fastening means 16. With this arrangement, magnet 22 will be capable of attracting the caps only at the side of body 20 near magnet 22, i.e., the bottom side of body 20 in the orientation of FIG. 3.

Figure 4A:
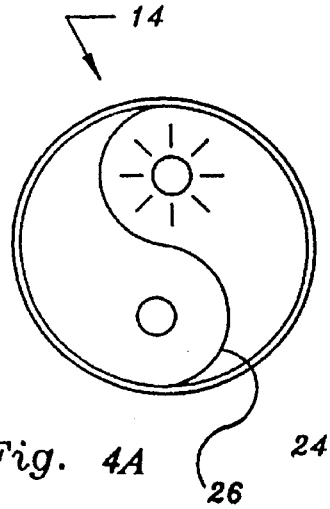
FIG. 4A is a front view of one of the caps produced in accordance with the preferred embodiment of the present invention, showing the overall shape of the cap and the decal located thereon.
Figure 4B:
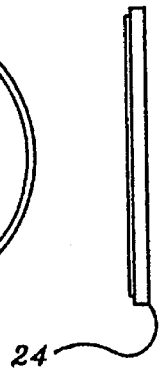
FIG. 4B is a side view of the cap of FIG. 4A.

The other integral component of the invention is the cap 14 as shown in FIGS. 4A and 4B. Here is shown the front and side views of the preferred embodiment of the cap portion of the invention. If used with a magnet, the cap 14 must be made of some ferrous material that can be attracted by an imposed magnetic field. Here is one example showing the cap 14 being comprised of a flat, cylindrical steel disk 24 with a decal 26 attached thereto. A disk approximately 1⅝ inches in diameter and approximately 0.05 inches thick has been found satisfactory. The decal 26 provides protection of the steel disk 24 from the environment and most of all individuality of the caps to promote the added skill of the players attempting to attract or "snag" specific caps located in the playing arena. Instead of casting the snagger into the general area of the caps, specific targets of individual caps will be sought out because of the player's desire to obtain that specific cap. The decal 26 that is shown here is only one example of an infinite variety of designs for the caps 14. The process of using a decal 26 is not imperative since the designs could be etched or engraved into the surface of the disk 24, thus eliminating the need for the separate part.

Figure 5:
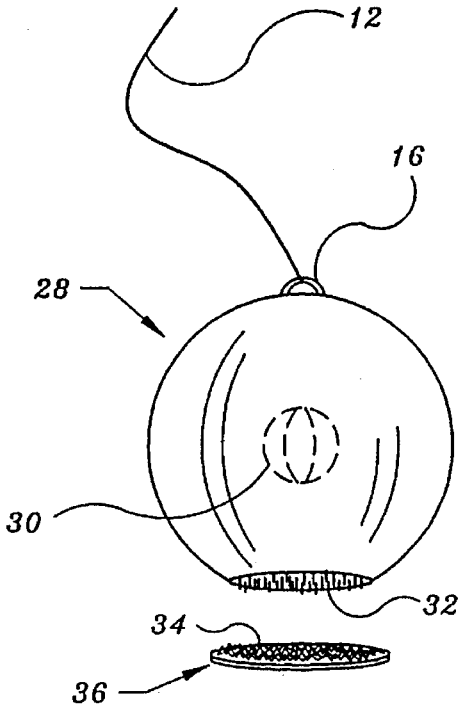
FIG. 5 is an isometric view of an alternative version of the invention showing a snagger and a cap with a hoop and loop type fastening means.

The function of the components of the invention are not specific to the device as illustrated thus far. An alternative to the preferred embodiment is shown in FIG. 5 in which the snagger 28 is an energy absorbing material with an attachment means 16 and an elastic cord 12 similar to that earlier described but now including a weight 30 and a fastener means 32. The mating fastener means 34 is located on at least one side of a cap 36. The snagger 28 is cast in a similar fashion as with the magnetic unit as described previously, but instead of a magnetic attraction of the snagger and caps there is a physical fastening of the snagger 28 to the cap 36 via the mating fastener means 32 and 34. This enables the user to "snag" one or more caps 36 upon casting the snagger 28 and retrieve the caps 36 that become attached. For this purpose a hook and loop type fastener would be preferable (VELCRO). With this embodiment, caps comprised of cylindrical paper disks approximately 1⅝ inches in diameter and approximately 0.10 inches thick, or of cylindrical plastic disks approximately 1⅝ inches in diameter and approximately 0.05 inches thick, have been found satisfactory.

The weight 30 is necessary when using similar materials to the earlier described in that those balance of weight must be maintained to provide optimal throwing and retrieving. This also includes the spring tension of the elastic cord 12 in relation to the mass of the snagger 28.

For the games described herein, played with either described embodiment of the snagger, an elastic cord 12 of length of approximately thirty inches has been found satisfactory.

EXAMPLES OF VARIATIONS IN GAMES

What are listed are examples of games that can be played using the disclosed invention. Variations in these games and novel games created by the users are to be expected.

MAG-SNAG POT

A circle is drawn on the ground of any size chosen by the players, providing the ability of each player's snagger to reach to the opposite side of the circle. Each player takes a position around the circle facing toward the center of the circle.

Each player deposits a determined number of caps into the circle. The distribution may be random, as in throwing the caps in the circle or defined whereas specific placement of the caps is determined. The players then assume their positions around the circle and cast their snaggers at the caps retrieving as many as possible in a sequential method of taking turns or in a time limited contest in which a casting "free-for-all" exists.

For an increased skill level game the caps can be determined to be face up or face down. The face down caps are poison (counted as a negative) and when one such cap is retrieved, that cap and an additional one must be placed in the circle.

CIRCLE WALK MAG-SNAG

This is a two player game in which each player places a series of caps on the ground so that the combined total caps form a circle. The players stand back to back and begin retrieving one cap at a time, in order, with their respective snaggers. Each player advances until the players meet and all caps have been retrieved. The player with the most caps wins.

IN LINE POWER CAPS

In this game the same procedure is followed as with the Circle Walk Mag Snag described previously with the exception that the caps are laid out in a straight line and not a circle. The players start one on each end and advance to toward the other player by retrieving the caps, one after another, in order.

FOUR SQUARE MAG-SNAG

Four players set an agreed upon number of caps in one of four straight lines, the combination forming a square. Each player stands at one comer of the square and casts at his or her caps. When a player retrieves all of his caps he may then turn (maintaining his corner or the square) and cast for any other caps that are still on the playing field. The player with the most caps wins.

What is claimed is:

1. A game comprising:

A. at least one cap, the cap comprising a small metal object capable of being attracted by a small magnet;

B. a snagger comprising a spherical structure of energy absorbing material having an annular recess therearound and a magnet capable of attracting said cap, the magnet being received therein; and C. an elastic tether having a first end and a second end, the first end being secured to said snagger and the second end of the tether being capable of being received by the hand of a user, whereby the user holds said snagger and tether in one hand with said second end of said elastic tether secured to a portion of the hand and projects said snagger toward the cap, making contact one with another and attracting same, and said elastic tether providing a means for retrieving the combination, and wherein the annular recess is capable of receiving the elastic tether when coiled around the snagger.

2. A game comprising:

A. at least one cap, said at least one cap capable of being attracted by a small magnet;

B. a snagger comprising a structure of energy absorbing material, and a magnet capable of attracting said cap received within the energy absorbing material and positioned within the energy absorbing material so that the magnet acts to attract the cap at only one side of the snagger; and C. an elastic tether having a first end and a second end, the first end being secured to said snagger and the second end of the tether being capable of being received by the hand of a user, whereby the user holds said snagger and tether in one hand with said second end of said elastic tether secured to a portion of the hand and projects said snagger toward the cap, making contact one with another and attracting same, and said elastic tether providing a means for retrieving the combination.

3. The game as described in claim 2 wherein said cap is a cylindrical steel disk approximately 1⅝ inches in diameter and approximately 0.05 inches thick.

4. The game as described in claim 2 wherein said cap further comprises an ornamental design located on at least one side thereof.

5. The game as described in claim 4 wherein said ornamental design is comprised of a printed decal fixed to said cap.

6. The game as described in claim 4 wherein said ornamental design is comprised of a design embossed into at least one surface of said cap.

7. The game as described in claim 2 wherein said magnet is a permanent magnet.

8. The game as described in claim 7 wherein said permanent magnet is a neodymium, grade 27 permanent magnet.

9. The game as described in claim 2 wherein said energy absorbing material is a foam rubber.

10. The game as described in claim 2 wherein said energy absorbing material further comprises the shape of a sphere with one side thereof receiving said magnet and the opposite side further comprising an attachment means for said elastic tether.

11. The game as described in claim 2 wherein said energy absorbing material further comprises the shape of a sphere with an annular recess provided which is capable of receiving said elastic tether when same is coiled thereon.

12. The game as described in claim 2 wherein said elastic tether is an elastic cord of approximately 30 inches in length with a loop disposed on said second end thereof.

13. A game comprising:

A. at least one cap, the cap comprising an object of minimal size and of a suitable material so as to be of minimal mass and a fastener means located on at least one side thereof;

B. a snagger comprising a spherical structure of energy absorbing material having an annular recess therearound and a fastener capable of mating with said fastener means of said cap, and located on at least a portion of one outer surface of the snagger; and C. an elastic tether having a first end and a second end, the first end being secured to said snagger and the second end being capable of being received by the hand of a user, whereby the user holds said snagger and tether in one hand with said second end of said elastic tether secured to a portion of the hand and projects said snagger toward the cap, making contact one with another and fastening thereto, and said elastic tether providing a means for retrieving the combination, and wherein the annular recess is capable of receiving the elastic tether when coiled around the snagger.

14. The game as described in claim 13 wherein said cap is a cylindrical paper disk approximately 1⅝ inches in diameter and approximately 0.10 inches thick.

15. The game as described in claim 13 wherein said cap is comprised of a cylindrical plastic disk approximately 1⅝ inches in diameter and approximately 0.05 inches thick.

16. The game as described in claim 13 wherein said cap further comprises an ornamental design located on at least one side thereof.

17. The game as described in claim 16 wherein said ornamental design is comprised of a printed decal fixed to said cap.

18. The game as described in claim 16 wherein said ornamental design is comprised of a design embossed into at least one surface of said cap.

19. The game as described in claim 13 wherein said fastener means is a hook and loop type fastener.

20. The game as described in claim 13 wherein said fastener means is comprised of mating hook and loop type fasteners, one located on said snagger and one located on said cap.

21. The game as described in claim 13 wherein said energy absorbing material is a foam rubber material.

22. The game as described in claim 13 wherein said elastic tether is an elastic cord of approximately 30 inches in length with a loop disposed on said second end thereof.

* * * * *